United States Patent [19]

Hosokoshi et al.

[11] 4,013,467

[45] Mar. 22, 1977

[54] METHOD OF MANUFACTURING COLOR PICTURE TUBES USING ROTATING LIGHT ATTENUATOR

[75] Inventors: Kakuichiro Hosokoshi, Neyagawa; Osamu Yoshida, Kyoto, both of Japan

[73] Assignee: Matsushita Electronics Corporation, Kadoma, Japan

[22] Filed: June 5, 1975

[21] Appl. No.: 584,067

Related U.S. Application Data

[62] Division of Ser. No. 264,356, June 19, 1972, Pat. No. 3,906,515.

[30] Foreign Application Priority Data

June 18, 1971 Japan ..... 46-44414

[52] U.S. Cl. ..... 96/36.1; 354/1

[51] Int. Cl.[2] ..... G03C 5/00

[58] Field of Search ..... 96/36.1; 354/1

[56] References Cited

UNITED STATES PATENTS

| | | | |
|---|---|---|---|
| 3,559,546 | 2/1971 | McKee | 354/1 |
| 3,667,947 | 6/1972 | McKee | 96/36.1 |
| 3,685,994 | 8/1972 | Frey | 96/36.1 |
| 3,725,106 | 4/1973 | Hosokoshi | 96/36.1 X |
| 3,736,848 | 6/1973 | Tsuneta et al. | 354/1 |
| 3,762,284 | 10/1973 | Park et al. | 354/1 |
| 3,764,366 | 10/1973 | Ninagawa et al. | 96/36.1 X |
| 3,783,754 | 1/1974 | Takemoto et al. | 96/36.1 |
| 3,856,525 | 12/1974 | Inoue | 96/36.1 |
| 3,876,425 | 8/1975 | Geenen et al. | 96/36.1 |
| 3,906,515 | 9/1975 | Hosokoshi et al. | 96/36.1 X |

*Primary Examiner*—Edward C. Kimlin
*Attorney, Agent, or Firm*—Cushman, Darby & Cushman

[57] ABSTRACT

This invention concerns an improvement in manufacturing of color picture tubes wherein photosensitive slurry is applied on the inner surface of a face panel of the tube and dried to form a dried slurry, then a shadow mask is secured to the face panel with a specified gap in between, and ultraviolet rays impinge on the dried slurry layer through a path-refracting lens and apertures of said shadow mask so as to form dots on the inner surface.

The improvement lies in provision of a light attenuator to control exposure distribution of the ultraviolet rays closely beneath the shadow mask. With this arrangement, sizes of the dots in the edge part of a screen can be made almost equal irrespective of changes of position of the ultraviolet ray source. Consequently, the dots for the three colors in the edge portion of the screen can be made substantially equal in size, and good color balance throughout the picture screen is obtainable.

1 Claim, 5 Drawing Figures

METHOD OF MANUFACTURING COLOR PICTURE TUBES USING ROTATING LIGHT ATTENUATOR

This is a division of application Ser. No. 264,356, filed June 19, 1972, now U.S. Pat. No. 3,906,515.

BACKGROUND OF THE INVENTION

This invention relates to an improvement in the manufacture of color cathode ray tubes. Particularly this invention is useful in manufacturing color cathode ray tubes having a so-called black matrix screen which is provided with a light-absorbing film forming a "black surround" filling the gaps between the color dots on the inner surface.

In the color cathode ray tube with the above-mentioned black matrix screen, the room light incident upon the screen surface is absorbed by the light-absorbing film, and accordingly, any decrease of contrast in the television picture due to the room light incident upon the screen surface is eliminated. In the color picture tube of this type, it is usual to provide firstly a light-absorbing film having a number of apertures on the inner surface of the face panel, and afterwards, a color-emitting phosphor dot is formed in each aperture.

There are two types of the above-mentioned color cathode ray tube; namely, a first type tubes wherein color phosphor dots are formed to have larger diameters than those of the electron beams which pass through the apertures of the mask and strike the dots, and a second type tube wherein color phosphor dots are formed to have smaller diameters than those of the electron beams which pass through the apertures of the mask and strike the dots. In manufacturing the second type tube, first a preparatory shadow mask is produced, which is initially provided with apertures smaller in diameter than those to be provided in the finished state of the shadow mask. By using this preparatory shadow maks, an ultraviolet ray exposure process is performed to form the light-absorbing film, i.e., a black matrix. By the subsequent process, the apertures of the shadow mask are enlarged by a secondary etching to a specified size as required in the finished tube.

According to a novel manufacturing method which was recently developed by applicant, entitled "direct exposure method", the diameters of the apertures of the light-absorbing film, and hence the diameters of the color dots formed in the apertures, can be made smaller than those of the apertures of the shadow mask without the above-mentioned secondary etching, by using a specially converged light-beam for exposure and by controlling the condition of development of the exposed dots. In accordance with this method, the subsequent enlarging of the apertures by secondary etching can be omitted. The present invention is useful when combined with such direct exposure method.

A typical known and conventionally used manufacturing process for the production of a color cathode ray tube is described in greater detail with reference to FIG. 1 which is a cross-sectional view showing the parts of a color screen exposure apparatus, and to FIG. 2 which is a graph showing the distribution of light-transmission (penetration) of a filter 5 used in the apparatus of FIG. 1.

In FIG. 1, a photosensitive slurry, made by blending a 1 to 7% polyvinyl alcohol aqueous solution with ammonium dichromate at a weight ratio of between 1:0.005 and 1:0.2, is evenly applied on the inner wall of a face panel 2 and is dried to form a photosensitive film 1, namely, a film of which the parts exposed to a specified amount of ultraviolet rays are hardened so as to be retained, i.e., developed, while the remaining parts are washed away. Then, a shadow mask 3 is installed at a predetermined position on the face panel 2. Subsequently, the photosensitive film 1 is exposed for a predetermined time to ultra-violet rays, which are derived from a point-light source 4 situated at a specified off-axis position in relation to the face panel, which position is called a deflection center of the tube. The rays are then passed through a light-attenuator 5, path-refracting lens 6 and the apertures of the shadow mask 3. Exposures in the above-mentioned way are made in three stages, namely, for red, green and blue dots, respectively, by placing the point-light source 4 at each deflection center for red, green and blue electron beams, respectively. Thus, a plurality of exposed points numbering three times the apertures of the shadow mask 3 are produced on the photosensitive film 1. Next, the shadow mask 3 is removed from the face panel 2, and the photosensitive film 1 is washed and developed in a hot or cold water shower. Therefore, a number of polyvinyl alcohol dot films are formed on the inner surface of the face panel 2. These dots are hereinafter called PVA dots, as generally known.

Next, a slurry of light-absorbing substance, such as aquadag or a substance which changes into a light-absorbing substance by heating, is applied to the inner surface of the face panel 2, and is dried. Then, the face panel 2 is immersed in a hydrogen peroxide bath, so that the above-mentioned PVA dots are dissolved and removed, simultaneously removing the light-absorbing substance remaining on the top of the dots. Thus, a light-absorbing film 1 with a number of apertures is formed on the inner surface of the face plate 2.

Color phosphor dots are to be applied in the apertures of the light-absorbing film 1, and accordingly, the areas of the color phosphor dots are defined by the diameters of the PVA dots. The diameters of the PVA dots are highly dependent on the extent of exposure, since the photosensitively of the polyvinyl alcohol-ammonium dichromate slurry is very high and the light-transmission into the slurry is also very high.

On the other hand, a good color balance of the picture on the screen is dependent on the uniformity of the sizes of the three phosphor dots of primary colors in each small area. Accordingly, in order to obtain good color balance across the picture screen, a uniformity of exposure is required throughout the screen.

In the conventional manufacturing method, a light-attenuator 5 having light-transmission distribution as shown in FIG. 2 was provided between the path-refracting lens 6 and the point-light source 4, as shown in FIG. 1.

In order to attain the required uniformity of exposure, the transmission rate at the edge parts F of the light-attenuator 5 was selected to be higher than that of the central part *b*, as shown in FIG. 2, and preferably, the light-attenuator 5 was rotated around the axis of the face panel 2 in order to avoid unevenness around the axis. One example of such prior art method was disclosed in the specification of the U.S. Pat. No. 3,259,038 of G.A. Burdick, et al., patented on July 5, 1966.

However, even with the use of such a light-attenuator, attainment of desired uniformity of exposure was not adequate since the light-attenuator 5 was situated beneath the path-refracting lens 6 and accordingly was situated too far from the shadow mask 3. If an edge part *d* on the photosensitive film is exposed to the light beam *c* from the light source 4 so as to form the PVA dots corresponding to the green phosphor dots and next is exposed to the light beam *e* from the light source 4 then situated at a position 4', as indicated by dotted line in FIG. 3, so as to form the PVA dots corresponding to red or blue phosphor dots, then the former light beam *c* passes through a point A of the light-attenuator 5 and the latter light beam *c* passes through another point B of the light-attenuator 5. As is shown in FIG. 2, light-transmissions of the point A and of the point B differ significantly. Accordingly, the exposure by the light beam *c* and that by the light beam *e* differ prominently from each other, so that attainment of exposure uniformity becomes impossible. This variation naturally causes considerable variation in the size of the phosphor dots in the small area d and hence causes deviation of the color from the proper color at the edge parts of the picture screen.

SUMMARY OF THE INVENTION

This invention purports a remarkable improvement over the prior art through elimination of the above-mentioned variation of the sizes of the phosphor dots providing different color emission at the edge area of the screen.

This invention particularly features the location of a light-attenuator closely beneath the shadow mask during the chemically active ray exposure process of dot forming.

BRIEF DESCRIPTION OF THE DRAWING

For a better understanding of the present invention, together with other and further objects, advantages and capabilities thereof, reference is made to the following disclosure and appended drawings, in which.

In all the figures, corresponding numerals indicate corresponding parts.

DETAILED DESCRIPTION OF THE INVENTION

Figure 1:
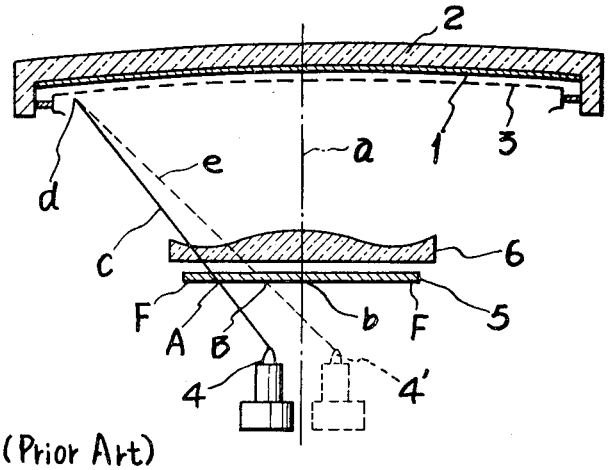
Fig.1 (Prior Art)
FIG. 1 is a cross-sectional view showing the principal parts of the above-described conventional apparatus for manufacturing a color picture tube.
Figure 2:
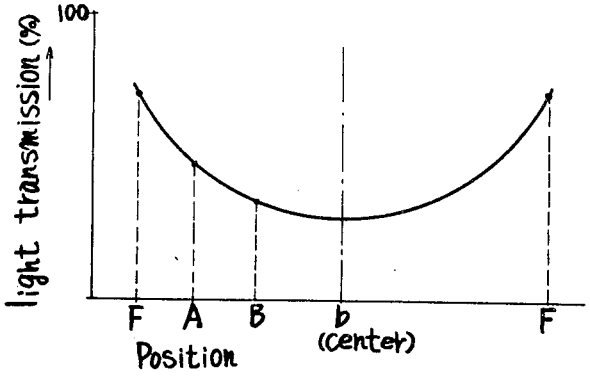
Fig.2 (Prior Art)
FIG. 2 is a graph showing the distribution of light transmission of the light attenuator used in the apparatus of FIG. 1, wherein the abscissa indicates position along a diameter of the light attenuator and the ordinate indicates relative light transmission.
Figure 3:
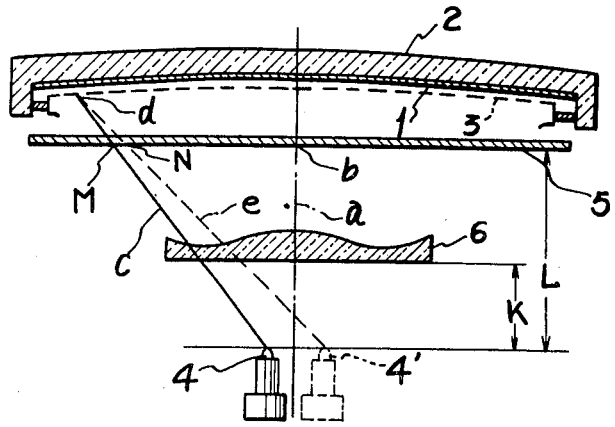
FIG. 3 is a cross-sectional view of the principal parts of an apparatus for manufacturing color picture tubes embodying the present invention.

In FIG. 3, like FIG. 1, a shadow mask 3 is secured to the inner surface of a face panel 2 with a specified gap inbetween. A conventional point-light source 4 capable of radiating ultraviolet rays, chemically active rays, for instance, from its tip is installed at the deflection center for a primary color. A known light-path refraction lens 6 is installed between the light source 4 radiating the chemically active light and the shadow mask 3. A light-attenuator 5, which has light-transmission as shown in FIG. 2, is installed closely beneath the shadow mask 3 in parallel with the principal part of the shadow mask 3. Such a location of the light-attenuator 5 is an important feature of the present invention.

The light-attenuator 5 may be a glass plate with a metal-vapor deposition layer of a specified density distribution, or may be a rotating shading blade having a predetermined shape for attaining the desired distribution of the light-transmission. The distance L between the light source 4 and the light-attenuator 5 should be more than 1.5 times the distance K between the light source 4 and the path-refraction lens 6. For instance, in case of a small color picture tube, having a spacing of 50 mm for the distance K, the distance L should be more than 75 mm.

As a result of selecting such a location for the light-attenuator 5, the light-paths *c* and *e* from the light-source positions 4 and 4', respectively, penetrate the light-attenuator 5 at the points M and N on the light-attenuator 5. As can be understood from FIG. 3, the distance between the points M and N is very small, and accordingly, the difference between the light-transmissions of the points M and N is very small. Therefore, the sizes of dots in a small part *d* formed by the different light beams *c* and *e* are substantially the same. This uniformity of the dot sizes enables attainment of good color expression and balance of colors across the entire picture screen.

In order to attain a good result, it is preferable to rotate the light-attenuator around its center. Also, in actual manufacturing of an apparatus, the light-source 4 is preferably installed in a light-house, on top of which said light-path refraction lens is provided as a lid. Such a practical embodiment is elucidated hereunder referring to FIG. 4 and FIG. 5.

Figure 4:
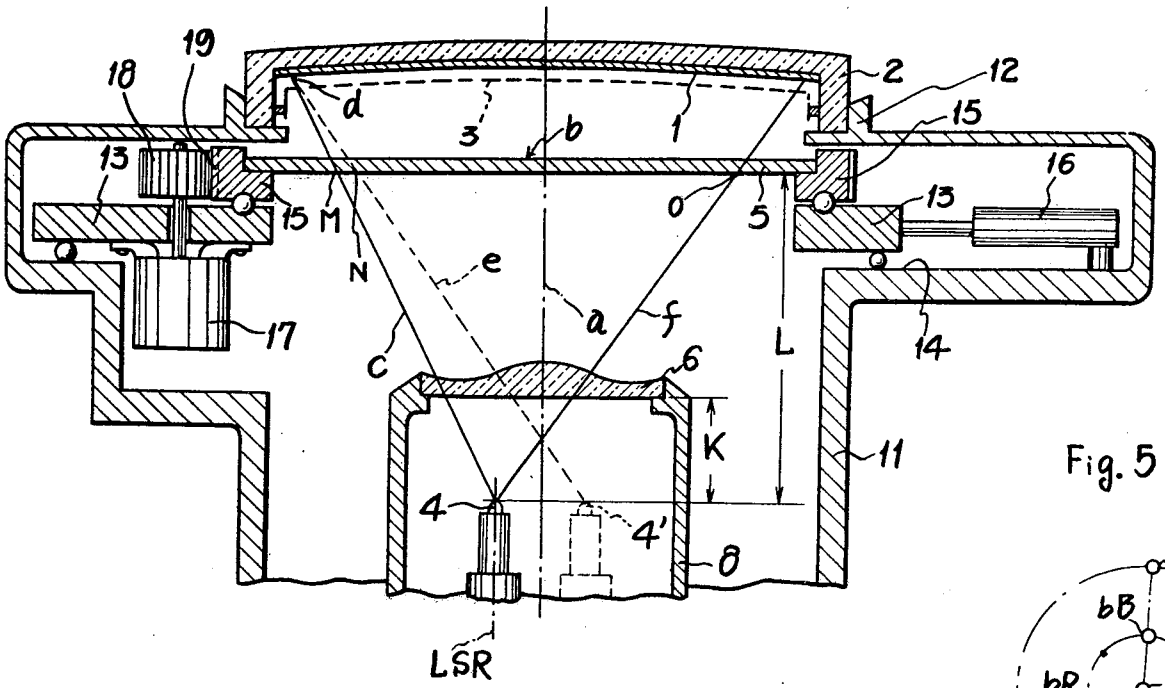
FIG. 4 is a cross-sectional view of the principal parts of another apparatus for manufacturing color picture tubes embodying the present invention.

In FIG. 4, the face place 2 is placed on the frame 11 and is supported by the projecting rim 12. The point light source 4 is installed in a light-house 8, on top of which the light-path refraction lens 6 is secured. The light-house 8 and the frame 11 are secured by any known securing means (not shown in the drawing). On a sliding table 14 of the frame 11, a movable frame 13 is provided in such a manner that it is capable of sliding on the table 14. A driving means 16, for instance including oil-pressure cylinders, is operatively linked to the movable frame so as to drive the latter for adjustment with respect to axis *a*. A rotary frame 15 which supports the attenuator 5 is provided on the movable frame 13 for rotation of the attenuator 5 around its axis. A motor 17 is secured to the movable frame 13 so as to rotate the rotary frame 15 through the linkage with the gears 18 and 19.

Figure 5:
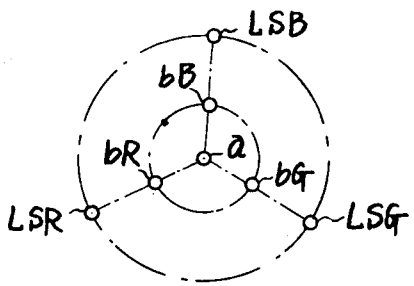
FIG. 5 is a plan view showing the relation between the tube axis, three off-center axes LSR, LSG and LSB at which the point-light source 4 is stopped, and another set of three off-center axes bR, bG and bB at which the center of the light attenuator 5 is stopped, for exposures to form dots of red, green and blue, respectively.

In the manufacturing process using the apparatus of FIG. 4, the center of the light-attenuator 5 can be shifted by the driving means 16 to an appropriate off-center position so as to attain the best uniformity of exposures. Namely, when the point-light source 4 is positioned on an off-center axis LSR as indicated in FIG. 5 for an exposure to form the red dots, the center of the light-attenuator 5 is positioned on an off-center axis bR. Likewise, the center is moved to other off-center axis bG and bB for exposure to form the green dots and the blue dots, respectively. Owing to such transfer to the center of the light-attenuator 5, possible adverse unevenness of the exposure between one edge part and the other edge part, which are positioned on opposite sides of the center, can be avoided.

Since the light-attenuator 5 is rotated around its center by the motor 17, possible unevenness of the exposure around the center of the shadow mask can be eliminated, even when there is a little strain or a streak on the attenuator 5. Moreover, such a light-attenuator as the known rotary shading blade of a specified shape, which should be rotated around an axis, can be utilized.

As will be mentioned below, according to the manufacturing method of the present invention, the diameters of the dots are controlled to fall within a small variation, such as ± 1.5% in contrast to the variation in the prior art, which has hitherto been as large as ± 10%.

One example of the color picture tube manufactured by the present invention utilizing the apparatus and method, as described with reference to FIGS. 4 and 5, and one example of the color picture tube manufactured by the conventional apparatus and method, as described with reference to FIG. 1, are compared as follows:

| ITEMS | Example by the Present Invention | Example by the Conventional Way |
|---|---|---|
| Outside diagonal length of face plate | 510 mm | 510 mm |
| Diameter of the light attenuator (made of metal deposited glass) | 360 mm | 130 mm |
| Distance K | 70 mm | 70 mm |
| Distance L | 180 mm | 68 mm |
| Distance between the attenuator and the shadow mask on the center axis of the latter | 90 mm | 202 mm |
| Maximum diameter of dots at edge part (microns) | 191 | 220 |
| Minimum diameter of dots at edge part (microns) | 185 | 180 |
| Vairation of diameters (microns) | 6 | 40 |
| Variation of diameters (%) | ±1.5 % | ±10 % |

As is understood from the foregoing table, the picture tube manufactured by the present invention has far better uniformity of dot diameter compared with the picture tube made in the conventional way.

As has been described in the above, this invention is very useful for forming the PVA dots, which are formed on the inner surface of the face plate, as a step of forming the light-absorbing film, namely a black matrix, in the manufacturing process of a color cathode ray tube. Also, this invention is applicable, for instance, to a process for forming the color dots of ordinary type color cathode ray tubes without the black matrix. Such variation is not to be regarded as a departure from the spirit and scope of the invention, and all such modifications are intended to be included with the scope of the following claims.

What is claimed is:

1. In a method of manufacturing a color screen for a color picture tube including the steps of:

coating a photosensitive film on the inner surface of a face panel of the tube, securing a shadow mask to the inner surface of the facepanel with a specified gap in between, and exposing the photosensitive film through apertures of the shadow mask, a light-attenuator and a path-refracting lens to light beams emitted from a point-light source positioned at an off-center position of the axis of the face panel, said light-attenuator controlling exposures at the photosensitive film being located between the lens and the shadow mask in closer proximity to the shadow mask, the improvement that the light-attenuator is semi-transparent with a specified distribution of light-transmission and rotates around an axis at its center during the light-exposure step, and that the distance between said point-light source and said light-attenuator is more than 1.5 times the distance between said point-light source and said refracting lens.

* * * * *